US009028338B2

(12) United States Patent
Chiono

(10) Patent No.: US 9,028,338 B2
(45) Date of Patent: May 12, 2015

(54) GOLF TRAINING EQUIPMENT

(76) Inventor: Roberto Chiono, Rivarolo Canavese (IT)

( * ) Notice: Subject to any disclaimer, the term of this patent is extended or adjusted under 35 U.S.C. 154(b) by 0 days.

(21) Appl. No.: 14/110,500

(22) PCT Filed: Apr. 10, 2012

(86) PCT No.: PCT/IB2012/051749

§ 371 (c)(1),
(2), (4) Date: Dec. 27, 2013

(87) PCT Pub. No.: WO2012/137189

PCT Pub. Date: Oct. 11, 2012

(65) Prior Publication Data

US 2014/0295984 A1 Oct. 2, 2014

(30) Foreign Application Priority Data

Apr. 8, 2011 (IT) ..... TO2011A0329

(51) Int. Cl.
*A63B 69/36* (2006.01)
*A63B 53/16* (2006.01)

(52) U.S. Cl.
CPC ..... *A63B 69/3676* (2013.01); *A63B 69/3661* (2013.01); *A63B 69/3685* (2013.01); *A63B 2209/08* (2013.01); *A63B 53/16* (2013.01);
(Continued)

(58) Field of Classification Search
USPC ..... 473/152, 155, 219, 220, 221, 222, 223, 473/224, 225, 226, 257, 266, 268, 278
See application file for complete search history.

(56) References Cited

U.S. PATENT DOCUMENTS 5,108,105 A * 4/1992 Shimizu ..... 473/225
5,114,150 A * 5/1992 Matsumura ..... 473/222
(Continued)

FOREIGN PATENT DOCUMENTS

GB 2096469 10/1982
GB 2107994 5/1983
(Continued)

OTHER PUBLICATIONS

Anonymou, M-04: Flux Detector, supermagnete—The Strangest Magnets in the World, Dec. 31, 2010, XP002684431, Retrieved from the Internet: URL:http://webarchive.org/web/20101231065206/http://www.supermagnete.de/eng/M-04 [retrieved on Oct. 2, 2012] the whole document.
(Continued)

*Primary Examiner* — Nini Legesse
(74) *Attorney, Agent, or Firm* — Workman Nydegger

(57) ABSTRACT

A training equipment usable to check the quality of the putt stroke comprising a base arrangeable on the ground and adapted to receive a golf ball in a predetermined position, magnetic flux detecting means applied to the base at least in front of and behind said predetermined position and so as to be visible from above the base, of the type adapted to visually show a trace depending on the variation of the pattern of the flux lines of the magnetic field applied to the base even after its removal; and at least a first magnet, preferably a permanent magnet, applied to the head base of a putter in correspondence of a part of the head intended in use to hit the ball, oriented so as to have while performing the putt stroke one of the poles facing the flux detecting means; a second magnet is available towards the flux detecting means with polarity opposite to the first so as to cancel the trace.

11 Claims, 2 Drawing Sheets

(52) U.S. Cl.
CPC ..... *A63B 69/3614* (2013.01); *A63B 2069/3679* (2013.01); *A63B 2225/00* (2013.01); *A63B 2243/0029* (2013.01)

(56) References Cited

U.S. PATENT DOCUMENTS

| | | | | |
|---|---|---|---|---|
| 5,474,298 | A * | 12/1995 | Lindsay | 473/222 |
| 5,826,874 | A * | 10/1998 | Teitell et al. | 473/225 |
| 6,437,559 | B1 * | 8/2002 | Zajac et al. | 324/179 |
| 7,465,237 | B1 | 12/2008 | Shoemaker | |
| 7,744,482 | B1 | 6/2010 | Watson | |
| 7,850,536 | B1 * | 12/2010 | Fitzgerald | 473/220 |
| 8,062,145 | B1 * | 11/2011 | Galloway | 473/225 |

FOREIGN PATENT DOCUMENTS

| | | |
|---|---|---|
| GB | 2110939 | 6/1983 |
| WO | WO 03/015878 | 2/2003 |
| WO | WO 2005/058425 | 6/2005 |

OTHER PUBLICATIONS

PCT/IB2012/051749, Oct. 3, 2012, International Search Report and Written Opinion.

* cited by examiner

GOLF TRAINING EQUIPMENT

CROSS REFERENCE TO RELATED APPLICATIONS

This application is a U.S. Nationalization of PCT Application Number PCT/IB2012/051749, filed on Apr. 10, 2012, which claims priority to Italian Patent Application No. TO2011A000329, filed on Apr. 8, 2011, the entireties of which are incorporated herein by reference.

TECHNICAL FIELD

The present invention relates to a training equipment usable by an amateur or professional golf player to check and, possibly, improve the quality of his/her "putt", i.e. of the (usually) last stroke with which one attempts to get the ball into the hole, or in the technical jargon of the field, "sinks the putt".

TECHNICAL BACKGROUND

As being part of the game of golf, control and quality of the putt are of the utmost importance. The statistics in fact confirm that the quality of the game and its outcome depends for more than 70% on this last stroke, which being the shortest in terms of distance of ball travel, is the most difficult and requires great precision and accurate movement (called "swing"), smoothly in line with the target (the hole).

At present, there is nothing on the market, except equipment using video cameras or sophisticated and expensive apparatus, for conducting the study and representation of one's own "putt swing" (i.e. "putt stroke" or simply "putt") visually reproducing the movement so as to visualize the defects and/or characteristics of a singular swing.

Both amateur and even more so professional players are therefore looking for a simple and inexpensive system that can substitute expensive instrumentation.

From the document U.S. Pat. No. 6,503,152 is known an apparatus which allows to be aware of certain characteristics of one's own putt, consisting of a rectangular, flat plate, being laid on the ground, oriented with the long sides in the direction of the hole; at a first and of said plane a recess is formed in order to receive in support the golf ball; a longitudinal groove runs parallel to the longer sides of the rectangular plane up at its opposite end, where, on both sides of the groove, between this latter and the major sides of the plane, are arranged a number of obstacles, usually consisting of golf balls arranged on a series of transverse grooves or notches. In the case of a non perfect stroke, the golf ball which has been enacted by the specific putter will collide with one or more obstacles, moving them; the player can therefore realize where and in what direction the ball was deflected.

This solution, though simple and relatively inexpensive, does not allow to detect the features of one's own "putt swing", but only to reveal immediate results.

GB2096469A discloses a device for golf training which includes a club or "iron" which has a magnetic substance in the lower part, a detection device fixed in several points and positions on a base for emitting signals to detect the movement of the head of the golf iron and devices for detecting and displaying the time and the movement of the iron. This requires a plurality of magnets positioned under the base, within special compartments, which, by interacting with the head of the iron of a magnetic material, determine a signal variation of the density of the magnetic wave, which is then "processed" by an electronic circuit. GB2096469A requires an especially made iron head and complex electronic circuits in order to operate as well as a power supply. Moreover, the information that is obtained relates exclusively, even when said system may be applied to a "putter", to that portion of the swing that is between groups of magnets spaced from each other by a predetermined distance which, in GB2096469A, is defined at the crossing point, i.e. of impact, with the golf ball, as can be seen from the position of the recesses housing the magnets and, therefore, cannot provide information relating to the whole section of the "back-swing", of the "down swing" and also of the "follow-through", which are essential to the putt stroke.

WO2005058425A2 discloses a device consisting of a mat with synthetic grass, which emulates the natural grass, which has the purpose of indicating to the golf player the impact point of the iron on the mat relative to the position of the golf ball. The mat is made of a material whose "blades of grass" bend on impact with the iron and remain bent leaving a visual sign ("trace") of the portion where the iron hit the mat, since the "blades of grass" are colored differently from one side relative to the other or with different color tones. To cancel the "trace" left by the iron, the player must pass his foot in the opposite direction to that of the golf iron, so that the blades of synthetic grass will straighten (or almost) in the vertical position. It is clear that this embodiment does not allow to obtain information about the trajectory of the swing, but only in relation to the impact point of the "iron" with respect to the ball. Moreover, the layout is clearly subject to premature wear.

Also in WO2005058425A2 is however reported that a similar result may be obtained with a honeycomb structured magnetophoretic table, inside which there are a plurality of chambers wherein a liquid of different nature and composition containing magnetic particles is placed; the liquid must have sufficient viscosity to allow the magnetic particles to move, but also such as to limit the effect of the gravity force that would re-deposit the magnetic particles. Said embodiment of the device necessarily requires micrometer-sized magnetic particles, so that they are affected as little as possible by gravity; in addition, the putter head must be entirely magnetic and this creates a number of drawbacks: if the whole head of the putter is magnetic it would leave a "trace" as wide as the putter head, since the magnetic particles would be entirely attracted by the magnetic flux; therefore it would not be possible to identify and interpret the movement of the swing; with such a wide trace, then, it would be possible to make visible only the trace of the "down-swing" and of the "follow-through" because the trace left in the "back-swing" would be deleted from the "down-swing"; but, above all, the magnetic particles suspended in the viscous liquid are attracted only vertically without distinction according to the line that is performed by the putter, therefore not providing any useful information to the player. To cancel the "trace", therefore, it is necessary to use a magnet of opposite polarity to that defined by the putter head.

WO03015878A1, finally, discloses a device with the purpose of indicating to the player the impact point of the iron relative to the position of the golf ball by means of the deformation which occurs in the impact point of the iron on a sheet of flexible material below which a viscous substance guarantees the permanence of the impression (deformation) generated by the impact of the iron. The application is therefore limited to training with irons or woods, and not with the putter and no information on the trajectory of the swing is given. To remove the impression, the device provides a "flattening mechanism" which, in one case, comprises magnetic particles contained in the viscous liquid and a unit that generates a magnetic field which, acting upon the magnetic particles, "moves" the viscous liquid and thus allows the flattening of the flexible mat.

DISCLOSURE OF INVENTION

The purpose of the present invention is to obviate the drawbacks of the systems described, providing a simple equipment, easy to create and use, reusable and at a relatively low cost, that allows to visually highlight the trajectory of one's own putt stroke, displaying the result of one's own putt movement both lifting ("back swing") and in lowering ("down swing") in at least the two-dimensional plane defined by the playing field and, eventually, even three dimensionally, so as to allow the player to recognize his or her own errors and defects and correct them.

According to the invention a training equipment is therefore provided usable in the game of golf to check the quality of the putt as indicated in claim 1.

In particular, the equipment according to the invention comprises a base arrangeable on the ground and adapted to restingly receive a golf ball in a predetermined position; and, preferably, means for performing a predetermined orientation of the base towards a target, in this case a hole of a golf course.

According to the main characteristic of the invention, the equipment comprises, in combination, a small permanent magnet at the base of the head of the putter, of dimensions substantially smaller than those of the head of the putter, and magnetic flux detecting means applied to the base, at least in front of and behind said predetermined position for the ball and so as to be visible from above the base, i.e. the side opposite to the playing field. The magnetic flux detecting means consist of sheets (also commercially available for other uses) made of a sol-gel polymer, preferably cut in a rectangular shape, containing in suspension a particle powder of a material susceptible to magnetic fields, e.g. nickel (but any other material susceptible to a magnetic field is equally suitable), glued or otherwise applied in a stable and integral manner to/on the base, parallel thereto. In the present case, the sol-gel polymer, green in color, contains nickel particles (black colored ferromagnetic metal) uniformly distributed in the mass of the polymer. Since the polymer is made up of a gelled substance, it allows the free migration (displacement) of the nickel particles (black colored) towards a magnetic source, both in parallel, and perpendicularly to the lying plane of the sheets, on the whole extension of the sheets themselves.

Consequently, when the magnet at the base of the putter head passes near the polymer surface, the magnetic field attracts the nickel particles to itself; the nickel particles, migrating through the polymer gel, thicken in a first area of the polymer sheet, i.e. are concentrated in the polymer in said first area in a greater amount of particles per area unit, for example per $mm^2$, visually returning upon the surface of the sheet facing in use, the putter, a line (mark or streak) being darker (due to the higher density of nickel). Said line is highly visible also due to the effect of contrast, since, on the contrary, on second areas of the sheet, placed on both sides of the first area, which has been subjected to maximum attraction intensity of the magnet, there is a clear mark or streak, as a result of the impoverishment of black nickel particles, due to the fact that from said second areas most of the particles have migrated to the first area.

An example of sheets usable in the present invention are sheets marketed by the firm SUPERMAGNETE Webcraft GmbH, based in Industriepark 202-78244 GOTTMADINGEN (Germany), with the name of "Flux Detector".

To be used in combination with the aforementioned base with magnetic flux detectors sheets is a modified putter, in which at least a first magnetic element, preferably a permanent magnet, is applied to the head base of the putter in correspondence of a part of the head intended in use to hit the ball.

Here and hereinafter, the term "magnetic element" is meant, indifferently, as an element consisting of a magnet, preferably a permanent magnet, or an element that can interact with the flux lines of a magnetic field, for example, concentrating them, as an element made of ferromagnetic material, such as iron or nickel.

The magnetic element is mounted on the putter oriented so that, when performing the put swing it passes in the vicinity of the sheets interacting with the same to form the aforementioned mark or streak, which therefore corresponds to the trajectory of the putter head during the stroke; in particular, in the case where the magnetic element is constituted by a magnet, the magnet passes with its pole downwardly in close proximity to the sheets leaving a visible trace upon the same.

The equipment according to the invention may also comprise a second magnet, preferably of larger sizes than those of the first magnet, carried for example by a handle of the putter, which second magnet may be arranged by the user towards the flux detecting means, e.g. by turning over the putter, so as to quickly erase the mark left on the same by the first magnet once the putt stroke has been performed and then free to repeat the shot, leaving a new trace upon the sheets.

Where the magnet passes placed at the base of the putter, it therefore leaves on the "Flux Detector" sheets applied to the base a dark mark or streak (trace) with clear edges, providing various useful information to the golfer, for example:

1. if the swing is straight or curved and uneven;
2. if the down swing is online or awry, therefore if the ball will be putted out of line to the target;
3. if the putter is moved evenly and always keeps the same distance from the ground or if it is tipped; in fact, in the case where said distance is not uniformly maintained it will be seen that the dark trace has constrictions and enlargements due to the fact that the magnet at the base of the putter moves away or closer to the magnetism detecting sheet.

After completion of the swing analysis, using the same putter it is possible to cancel the mark left, for example using the second magnet, or even the putter head itself, making it oscillate transversely to the mark in order to horizontally move the nickel particles up to restore their initial uniform distribution in the sol-gel polymer. The equipment according to the invention is therefore reusable indefinitely, without wear.

From the foregoing, it is clear that the same functionality is obtained by inverting the equipment "magnetic" components. For example, within the sol-gel magnetic particles may be suspended, in the sense that they generate a magnetic field, which is therefore constantly applied to the base, for example magnetite particles, possibly associated with a colored pigment. In this case, the magnetic element associated with the putter head is nothing but a mass of iron or nickel, which, passing during the swing in the vicinity of the sol-gel sheets equipped with particles generating a magnetic field locally modifies the course of the flux lines, making the magnetic field more intense in the vicinity of the passage of the putter head. Also in this case, therefore, the particles in suspension in the sol-gel can migrate freely within the entire extent of the sol-gel sheets, moving both horizontally then vertically, leaving on the surface of the sol-gel sheets the desired mark or trace. In this case, to cancel the trace it will be possible to use a magnet or pass the putter in the vicinity of the same, as previously described, possibly reversing the base. Conveniently, in this case, the base is made of a transparent material; in this way, once overturned the base and erased the mark, the player will be ready for another swing.

Preferably, the base can be constituted by a plane rectangular polymeric sheet, rigid or flexible, rollable in the second case, in order to be easily transported, placed and removed from the playing field.

BRIEF DESCRIPTION OF THE DRAWINGS

Further characteristics and advantages of the invention will become clear from the description that follows of a non-limiting embodiment thereof, made with reference to the figures of the accompanying drawings, wherein.

PREFERRED EMBODIMENT OF THE INVENTION

With reference to FIGS. 1 to 4, is indicated as a whole with 1 a training equipment usable by a golf player 2 to check the quality of the putt stroke.

Figure 1:
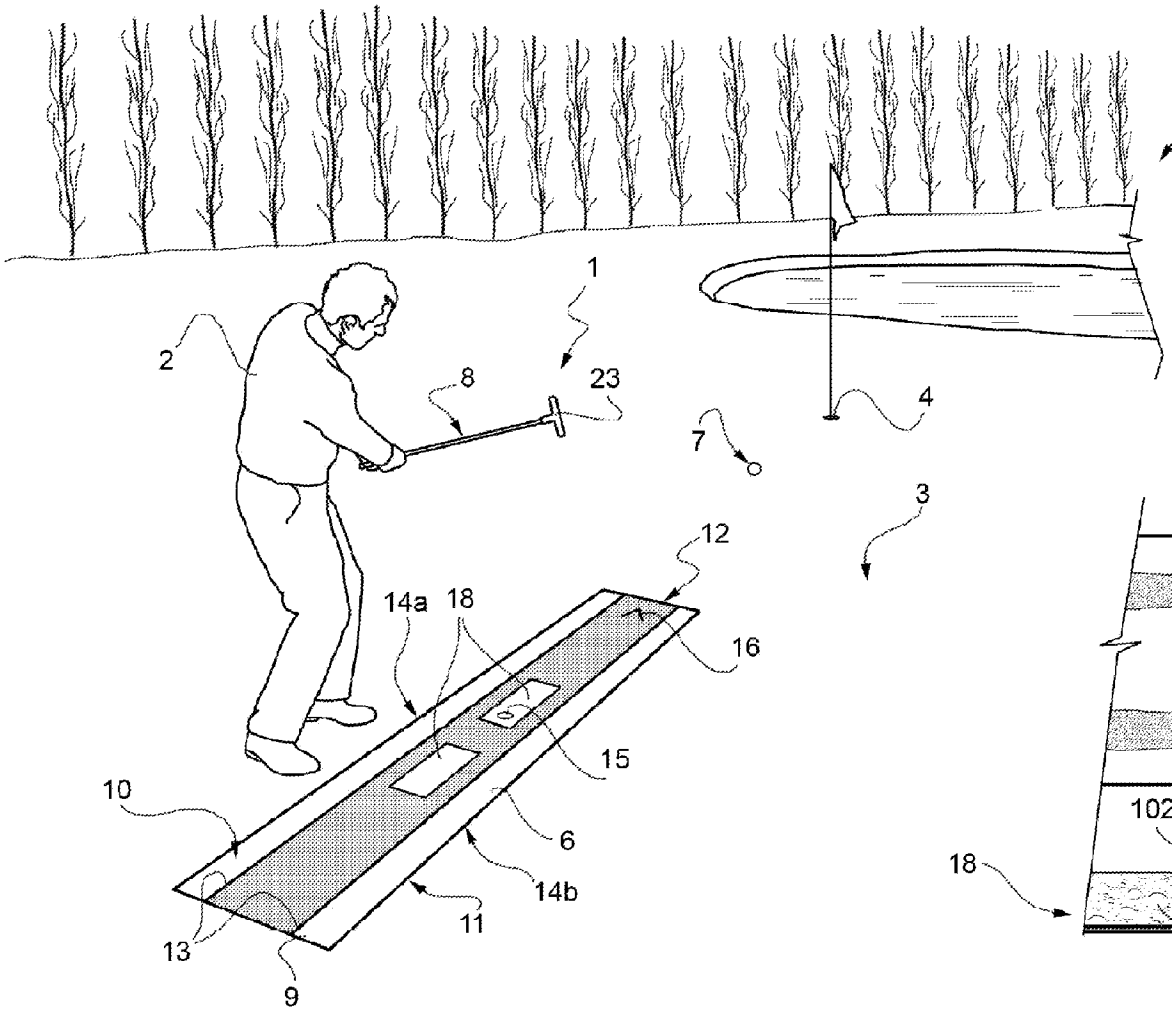
FIG. 1 schematically illustrates a golf playing field and a player ready to perform a putt stroke using the training equipment according to the invention.
Figure 4:
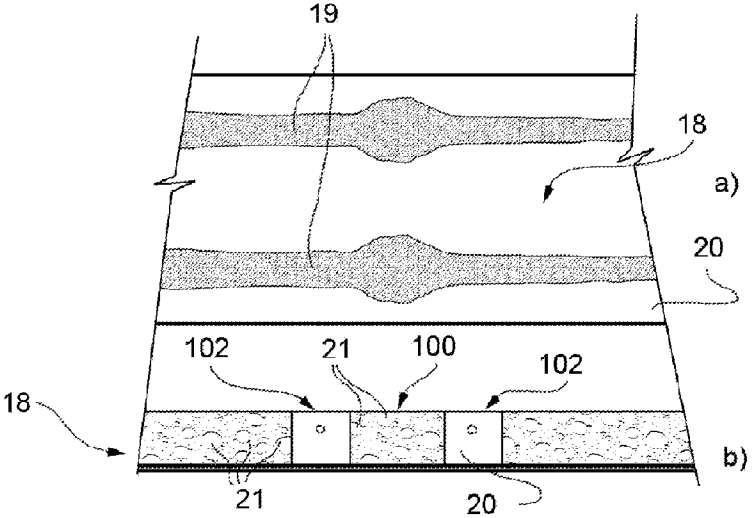
FIG. 4*a* shows in a larger-scale a plan view of an essential component of the apparatus of FIG. 1, of which it schematically illustrates the appearance after the performing of a putt stroke by a player.
FIG. 4*b* illustrates out of scale, without observing the relative proportions for the purpose of clarity, a cross section of the component of FIG. 4*a*, in order to illustrate in a schematic way the internal structure.
Figure 2:
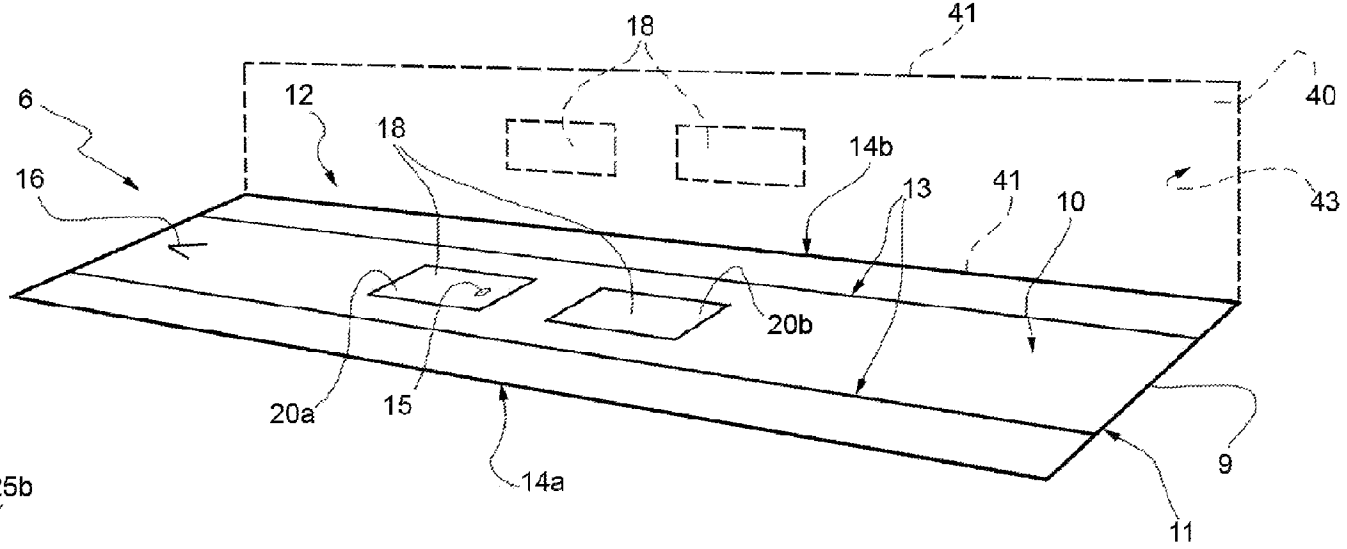
FIG. 2 shows a perspective view of a first element of the equipment according to the invention, an optional part of which is schematically illustrated in broken lines.

The apparatus 1 is intended to be arranged directly on a playing field 3, in the vicinity of a hole 4 of a golf course 5 (or even at home or another suitable practice place) and comprises a base 6 arrangeable on the ground, in this case arrangeable on the playing field 3 and adapted to restingly receive a golf ball 7 in a predetermined position, which, in FIG. 1, is shown during a time of its travel towards the hole 4, after the performing of a putt stroke or, simply, putt by the player 2 through a complex movement of swinging a putter 8, in the known general structure, called swing. The equipment 1, further comprises the putter 8, which, as will be seen, is a putter, i.e. for performing the putt stroke, which retains the general structure and the functionality of a normal putter of the same type, but which was, according to the invention, slightly modified by the addition of one or more components, possibly removable therefrom, in order to restore it to a "normal" putter.

The base 6 (FIGS. 1 and 2) is formed by a first rectangular sheet 9, rigid and flat, or slightly flexible so as to be able to adapt to the ground surface, made of a polymeric material of predetermined thickness, preferably but not exclusively transparent, the material preferably being selected from the group consisting of PLEXIGLAS® and LEXAN®; it is clear that even acetal resins or silicone or other polymers suitable for the purpose are also equally usable. The sheet 9 constitutes the part of the base 6 intended to receive the ball 7 in the mentioned predetermined position on one of its upper face 10, facing in use the side opposite to the playing field 3; said part of the base 6 formed by the sheet 9 is also that intended in use to remain arranged on the playing field 3, parallel thereto, in this case with its own lower face 11, parallel and opposite to the face 10.

The base 6, in this case the sheet 9, preferably, but not necessarily comprises, means 12 for allowing to carry out a predetermined orientation of the base 6 towards a predetermined target, typically consisting in the hole 4.

Said means 12 for allowing to carry out a predetermined orientation of the base 6 comprise, in the non limiting example shown, at least a pair of mutually parallel rectilinear lines 13 carried by the base 6, in this case silk-screened upon the surface 10 of the sheet 9 (it is clear that any other printing method, such as pad printing, is equally suitable), for the entire length of the respective, opposing longitudinal sides 14*a*, 14*b*, of greater length, of the rectangular sheet 9; lines 13 may also be present in greater number, for example, formed in a central position and/or oblique, more generally in any number and position which could be of help to the player 2 for the understanding of the characteristics of its stroke. If the sheet 9 is transparent, the lines 13 may be silk-screened/obtained, of course, also on the face 11. The means 12 further comprise, preferably, at least a first mark 15 designed to mark on the sheet 9, the mentioned predetermined position in which predispose the ball 7 on the basis 6 before performing the putt stroke; said mark 15 may be a design or silk-screened logo, like the lines 13, or be defined by a true and proper seat for the ball 7 formed on, or carried by the face 10, for example defined by a hollow hemispherical cup or a through hole of suitable diameter, preferably, the base 6, in this case the sheet 9, also presents a second mark 16, for example screen-printed on the sheet 9, to indicate visually to the player 2 one end of the base 6 intended in use to be directed towards the target, in this case the hole 4 when the base 6 is positioned on the playing field 3.

According to the main aspect of the invention, the equipment 1 also comprises magnetic flux detecting means 18 that are applied to the base 6 at least in front of and behind said predetermined position for the ball 7 marked by the mark 15 and so to be visible from above the basis; and then the detecting means 18 may be preferably applied on the upper face 10 of the sheet 9 or, if this is made of a transparent material, also on the face 11, remaining at this point visible through the thickness of the sheet 9.

The magnetic flux detecting means 18 are arranged parallel to the lines 13, preferably within the longitudinal portion of sheet 9 between the same, so that the magnetic flux detecting means 18 are located in use always correctly oriented, in longitudinal sequence, between the lines 13, securely aligned, one after the other, in the direction of the target (the hole 4).

According to the invention, the magnetic flux detecting means 18 consist of sheets 20 of a sol-gel polymer of any known type and substantially transparent, preferably of green color, therefore flexible, preferably cut in rectangular form, containing in suspension in the sol-gel polymer a powder of particles 21 of a material susceptible to magnetic fields, preferably formed by particles of nickel, then black color; the sheets 20, arranged at least one in front of and one behind the predetermined position for the ball marked by mark 15, are glued or otherwise applied in a stable and integral way to the base 6, parallel thereto, in this case glued on the face 10 of the sheet 9.

Said sheets 20 are obtained by cutting into suitably sized, sheets called "Flux Detector", commercially available through the German company SUPERMAGNETE Webcraft GmbH, based in Industriepark 202-78244 GOTTMADINGEN. In these sheets 20 the particles 21 are free to migrate both parallel to a lying plane of the sheets 20, which are flat, and perpendicular to said lying plane, on the whole extension of the sheets 20, under the effect of a local subjection to a magnetic field, creating on the exposed surface of the sheets 20, in this case that facing in use the putter 8, a mark or streak or trace 19 (FIG. 4) visible to the naked eye even after removal of the magnetic field; i.e. the trace 19, once formed, as will be seen, due to the presence of a magnetic field, remains even in the absence of magnetic field, whose flux lines are substantially perpendicular to sheets 20 themselves, so for example when they are close to the poles of a magnet.

In this way, the sheets 20 are adapted, according to the use that the present invention makes of the same, to show on their surface the visual trace of the passage of a magnet in their proximity, which reproduces the displacement trajectory of the relative magnet/sheets, the trace or mark or streak 19 in fact.

In combination with the presence of the sheets 20 on the base 6, the equipment 1 according to the invention also comprises at least one first magnet 22 (FIG. 3), preferably a permanent magnet, which according to an aspect of the invention is adapted to be applied to the base of a head 23 of the putter 8, in correspondence of a part of the head 23 intended in use to hit the ball 7.

The magnet 22 is of a size significantly smaller than those of the head 23, which is preferably made of a non-magnetic and/or non-magnetizable material, and is carried by the putter 8 oriented so as to have, during the performing of the required swing of a putt stroke, one of its opposite poles, in the non-limiting embodiment shown the positive pole, facing the flow detecting means 18, i.e. towards the sheets 20 carried by the sheet 9. The other pole, in the example shown, the negative one, is facing a shaft 24 of the putter 8.

The equipment 1 may also comprise a second magnet 25, preferably adapted to be carried by a handle 26 of the putter 8, the magnet 25 having a larger size than that of the magnet 22 and may be available in use, by the player, towards the magnetic flux detecting means 18 with opposite polarity to that of the first magnet 22; in this way the mark or trace 19 left on the same by the first magnet 22 can be quickly erased once the putt stroke has been performed; similar effect would be obtained simply by swinging the head 23 equipped with the magnet 22 transversely to the mark 19; in fact, the mark 19 is formed as the polymer with which the sheets 20 are made, constituted by a gelled substance, allows, as already said, the free migration (displacement) of the magnetic particles 21 towards a magnetic source, both in parallel, and perpendicularly to the lying plane of the sheets 20 and on the whole extension of the sheets themselves.

Consequently, when the magnet 22 located at the base of the head 23 of the putter 8 transits in the vicinity of the sheets 20 during a swing, the magnetic field attracts the particles 21 (of nickel) to itself; the particles 21, migrating through the gelatinous polymer, are thickened in a first area 100 (FIG. 4*b*) of the polymer sheet 20, i.e. are concentrated in the polymer in said first area 100 in a greater amount of particles 21 per area unit, returning visually on the surface of sheet 20 facing in use towards the putter 8, a line (mark or streak) darker due to the higher density of particles 21. Said dark line is highly visible due to the contrasting effect, since, on the contrary, on second areas 102 of the sheet 20, placed on both sides of the first area 100 along a direction transverse to the lines 13, can be seen a clear line, as an effect of the impoverishment of particles 21 in the areas 102, due to the fact that in such areas 102 most of the particles 21 originally present (the particles 21 are distributed uniformly in the sheets 20 before use) have migrated in the area 100.

During the swing a mark 19 will therefore be obtained, graphically depicting the trajectory traveled by the head 23 in front of the sheets 20 and caused by the contrast that is created between the first areas 100 of the sol-gel polymer, which extend parallel to the lying plane of the sheets 20, wherein a concentration per area unit of the particles 21 is greater, due to the thickening, and the second areas 102 of the sol-gel polymer, which as well extend parallel to the lying plane of the sheets 20 and which are immediately adjacent to the first areas 100, wherein a concentration per area unit of the particles 21 is less, due to thickening of the particles in the first areas 100. Subsequently, the magnet 25 or the transverse oscillation of the head 23 equipped with the magnet 22 takes back the particles 21 migrated in the area 100 towards the areas 102, thereby restoring the substantially uniform distribution of particles 21 in each polymer sheet 20.

In the non-limiting example shown, the magnets 22 and 25 are fixedly housed, but oriented with opposite polarities, in respective seats formed in the base of the head 23 and the handle 26 of the putter 8; alternately, the magnet 22 is a cylindrical magnet, for example made of neodymium (FIG. 3), supported by a plaque/plate 105 of adhesive-removable PVC which also has the function of limiting the emission of the magnetic flux only to the exposed portion of the face of the magnet 22. This allows to obtain, in the case of a correct swing, a trace on the polymer sheets 20, one well defined and precise mark or trace 19. The magnet 22 with the relative plaque/plate 105 is therefore simply glued, or otherwise applied, at the base of the head 23 of the putter 8, with one pole, for example positive, facing outwards and the other, for example the negative, facing the handle 26.

Figure 3:
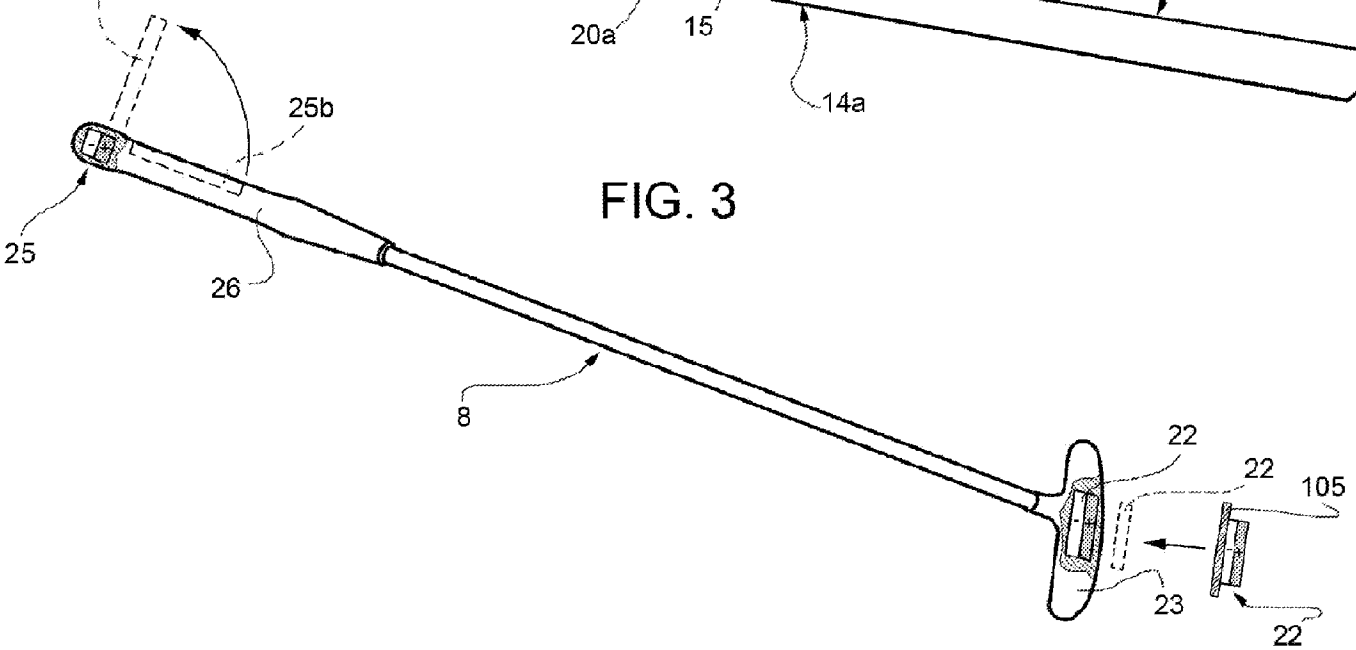
FIG. 3 shows a perspective view of a second element of the equipment according to the invention, in this case consisting of a putter, possibly modified to be uniquely designed to be used in conjunction with the element of FIG. 2.

The magnet 25 is, in the illustrated example, a parallelepiped magnet 25*b*, mounted rotatably clasped, in such a way obvious for the skilled in the art, on the handle 26, or inserted in the handle 26 by means of a cap or other suitable system, so as to be normally housed within the handle 26 and, when necessary, brought into the position shown in broken lines in FIG. 3, laterally arranged projecting from the handle 26, perpendicularly thereto, and having a length substantially equal to the transverse width of the sheets 20.

In use, the base 6 is arranged on the playing field 3 oriented so that the hole 4 is targeted between lines 13; the sheets 20 do not bear any imprint or trace 19, having not yet been subjected to any magnetic field.

Therefore the ball 7 is arranged on the mark or seat 15, which is arranged between two (or more) sheets 20 aligned in longitudinal sequence in the direction of the hole 4, on the sheet 9.

The player then normally 2 performs the swing, but using the putter 8 after having applied to the same at least the magnet 22 (which, along with any magnet 25, is an integral part of the equipment 1), arranged in the position described.

During the swing, the magnet 22 is therefore always facing the sheets 20 to magnetically interact with the particles 21 contained therein and cause the thickening of the sol-gel polymer in correspondence of a trajectory facing the sheets 20 traveled by the head 23 during the putt stroke.

In essence, as a result of the swing, the positive pole (but could also be the negative pole) of the magnet 22 passes in the vicinity of the upper surface of the sheets 20, applying to the same the own magnetic field and, consequently, creates on the surface of the sheets 20 facing in use the head of the putter 8 a line visible to the naked eye, the trace or mark or streak 19 in fact, which corresponds to the trajectory of the head 23 of the putter 8 when performing the stroke. Where the magnet 22 passes, located at the base of the putter 8, it therefore leaves on sheets 20 applied to the base 6 a dark mark or trace 19 with clear edges, illustrated schematically in FIG. 4*a* by way of two striped bands.

Said bands may have variable widths (in the direction perpendicular to the lines 13), depending on the distance from the surface of the sheets 20 to which is placed, from time to time, the magnet 22; they will also show, if visually compared with the course of the lines 13, any lateral movements made by the magnet 22 (and thus by the head 23 of putter 8) during the swing. The mark or trace 19 then gives to the player 2 complete visual information about how the swing has been performed, both in the longitudinal (width), transverse (alignment with the hole 4) and vertical direction, showing both the part of movement relative to the back swing (sheet 20*b* arranged on the opposite side to the mark 16 with respect to the mark 15—FIG. 2) and relative to the down swing (sheet 20*a* arranged towards the mark 16 and on one end of which there may be the mark 15, seat of the ball 7 before the stroke).

Once the visual analysis of the swing is finished, usually performed as the equipment 1 has the least impact on the performing of the stroke (unlike many known solutions, such as according to U.S. Pat. No. 6,503,152), the player 2 may proceed to cancel the trace 19 to perform another swing with successive analysis. Obviously, with a magnet as the 25*b* just one passing is enough to delete the whole trace 19.

According to a possible variant of the equipment 1 just described, the base 6 can be formed not only by the sheet 9, but by a second rectangular sheet 40, rigid and flat, for example made of the same polymeric material of the sheet 9 and fixed to the sheet 9, perpendicularly thereto, along the respective long sides 14 with one of its long sides 41; in this case one side 41 of sheet 40 is fixed to the side 14*b* of the sheet 9. The sheet 40 is also provided, on one face 43 facing the sheet 9, of magnetic flux detecting means 18 (at least two sheets 20) applied thereto at least in front of and behind said predetermined position for the ball 7 highlighted by the mark 15.

In use, the sheets 20 of the sheet 40 are subjected, during the swing, to the flux lines of the moving magnetic field generated by the magnet 22 during the swing itself and, therefore, will also show, at the end, after performing the stroke, a mark or trace 19 which illustrates the vertical movement of the swing, allowing the player 2 to make a three-dimensional analysis of his/her own swing.

According to a further possible embodiment, also, the base 6 can be formed from a single rectangular plane sheet 9 of a polymeric material, preferably transparent, but that instead of being rigid or partly flexible, is a flexible material to such an extent that it can be rolled and unrolled, for example in the direction of its major sides 14, for example made of silicone or silicone rubber. Also in this case, the sheet 9 will be provided on one of its faces, preferably the upper face 10, of the sheets 20, made in the form of a flexible polymeric sheet, and of the orientation means 12.

Finally, from that described it is clear that, according to a further possible variant of the invention, the sheet 9 may be entirely coated on the surface 10 of sheets 20; in this case, the equipment 1 can also comprise a modified golf ball 7, in the sense that it is made so as to be magnetized or so as to contain a magnet, while keeping weight and size of a standard golf ball. In this case, therefore, the rolling of the ball 7 on the surface 10 in consequence of the putt stroke will leave on the sheets 20 a continuous mark or trace 19, visually showing the exact trajectory followed by the ball 7 during the initial phase of the shot, i.e. before coming into contact with the playing field 3.

From the above description is finally clear that, according to a possible variant of the embodiment illustrated, the generation of the magnetic field necessary for the operation of the invention, instead of being entrusted to the magnet 22 may be entrusted to the particles 21 in suspension in the sol-gel that, in this case, will not be magnetizable particles, but magnetized particles (for example made of magnetite possibly pigmented).

The magnet 22 can then be replaced by a simple mass 22 of iron or nickel, or of a ferromagnetic material which, passing in the vicinity of the magnetic particles 21 contained in the sol-gel sheets 20 during the swing causes a change in pattern of the flux lines (concentration) that, similarly to that already described, makes the particles 21 migrate horizontally within the polymer sheets 20 and towards the surface of the sheets 20, so as to generate the mark or trace 19.

The invention claimed is:

1. A training equipment usable by a golf player to check the quality of his/her putt stroke, comprising:

a base arrangeable on the ground and adapted to restingly receive a golf ball in a predetermined position;

a putter;

magnetic flux detecting means applied to the base at least in front of and behind said predetermined position of the ball; and magnetic means carried by a head of a putter so as to interact with said magnetic flux detecting means when, performing a putt stroke, the head of the putter passes near the magnetic flux detecting means;

wherein:

i)—the magnetic flux detecting means are applied to the base so as to be visible from above the base;

ii)—the magnetic flux detecting means consist of: at least one pair of flat sheets made of a sol-gel polymer applied to the base at least one in front of and one behind said predetermined position for the ball, either glued or otherwise firmly and integrally applied to said base, parallel thereto; and in particles of a material susceptible to magnetic fields, the particles being contained in uniform suspension within the sol-gel polymer of said sheets so that the particles can migrate freely both parallel and perpendicular to a lying plane of the flat sheets for the whole extension of said sheets;

iii)—the magnetic means consist of a first magnet oriented such as to have in use, when performing the putt stroke, one of its opposite poles facing said sheets, the first magnet being applied or applicable to the base of the head of the putter at a part of the head intended in use to hit the ball to magnetically interact with said particles;

iv)—causing the suspension of said particles in the sol-gel polymer to become denser in correspondence of a trajectory facing the sheets traveled by the head during the putt stroke itself, so as to create on a surface of the sheets facing in use towards the head of the putter, a mark or streak visible to the naked eye and reproducing graphically the trajectory traveled by the head in front of said sheets;

v)—said mark or streak being caused by the contrast that is created between first areas of the sol-gel polymer, which extend parallel to the lying plane of the sheets, wherein a concentration per unit area of the particles is greater due to the effect of the suspension of the particles becoming denser, and second areas of the sol-gel polymer, which extend parallel to the lying plane of the sheets and which are immediately adjacent to the first areas, wherein a concentration per unit area of the particles is less, due to the effect of the suspension of the particles becoming denser in the first areas; and vi)—said first magnet being of a smaller size than those of the head of the putter, said head being made of a non-magnetic and/or non-magnetizable material.

2. The equipment according to claim 1, wherein said sheets of sol-gel polymer contain in suspension in the sol-gel polymer nickel particles.

3. The equipment according to claim 1, further comprising a second magnet, carried by a handle of the putter, which second magnet may be arranged by the user towards the flux detecting means, with polarity opposite to the first magnet and/or of larger sizes than those of the first magnet, so as to cancel said mark or streak once the putt stroke has been performed.

4. The equipment according to claim 3, wherein the first and second magnets are fixedly housed, oriented with opposite polarities, in respective seats obtained within the base of the head and of the handle of said putter.

5. The equipment according to claim 1, wherein the first magnet is a cylindrical magnet either glued or otherwise applied to the base of the head of said putter with one pole facing outwards and the other facing the handle; with the interposition of a plate in polymer material.

6. The equipment according to claim 1, wherein said base further comprises means for allowing to carry out a predetermined orientation of the base towards a target so that said sheets are securely aligned, one after the other, in the direction of the target.

7. The equipment according to claim 6, wherein said means for allowing to carry out a predetermined orientation of the base towards a target comprise at least one pair of rectilinear lines parallel to each other and carried by the base, between which said sheets are arranged in longitudinal sequence.

8. The equipment according to claim 7, wherein means for allowing to carry out a predetermined orientation of the base towards a target further comprise at least a first mark or a seat obtained on the base and adapted to mark said predetermined position for the ball and a second mark for mark one end of the base intended to face the target in use.

9. The equipment according to claim 1, wherein said base is formed by a either rigid or partially flexible, flat rectangular sheet made of a polymeric material selected from the group consisting of PLEXIGLASS®, LEXAN®, acetalic resins, silicone resins, on a face of which said sheets are firmly applied.

10. The equipment according to claim 9, wherein said base is further formed by a second flat, rectangular rigid sheet, fixed to the first sheet, perpendicular thereto, along the respective long sides of the first and second sheet; the second sheet being also provided, on a face facing the first sheet of magnetic flux detecting means applied to the second sheet at least in front of and behind said predetermined position for the ball.

11. The equipment according to claim 1, wherein said base is formed of a single, flat rectangular sheet of a polymer material, transparent, flexible so as to be rolled up and unrolled, provided with said magnetic flux detecting means on a face thereof, which are also made in the form of flexible polymer sheets.

* * * * *